US006334423B1

(12) United States Patent
Mashimo

(10) Patent No.: US 6,334,423 B1
(45) Date of Patent: Jan. 1, 2002

(54) RECIPROCATING PISTON ENGINE AND ITS LINK MECHANISM

(76) Inventor: Hayami Mashimo, 25-3, Asahigaoka, Hidaka-shi, Saitama (JP)

( * ) Notice: Subject to any disclaimer, the term of this patent is extended or adjusted under 35 U.S.C. 154(b) by 0 days.

(21) Appl. No.: 09/081,075

(22) Filed: May 19, 1998

(30) Foreign Application Priority Data

Jul. 16, 1997 (JP) ..... 9-207066

(51) Int. Cl.[7] ..... F02B 75/32

(52) U.S. Cl. ..... 123/197.4; 74/40; 74/43; 74/51; 123/53.5

(58) Field of Search ..... 123/53.5, 197.4; 74/38, 40, 41, 43, 51

(56) References Cited

U.S. PATENT DOCUMENTS 1,415,852 A * 5/1922 Horn ..... 123/53.5

2,677,280 A * 5/1954 Ceulemans ..... 74/40

* cited by examiner

*Primary Examiner*—Noah P. Kamen

(74) *Attorney, Agent, or Firm*—Browdy and Neimark

(57) ABSTRACT

A link mechanism for a reciprocating piston engine and the like is characterized in that: motions of a pair of cylinder-type pistons moving in opposite directions relative to each other are converted into an oscillating-type rotary motion through an oscillating arm provided with a right and a left portion, which portions are equal in mass and in turning radius of their oscillating-type rotary motions; and, the oscillating-type rotary motion is divided into two equal parts by connecting rod means and transmitted to the link mechanism in which the two equal parts of the oscillating-type rotary motion are converted into a rotary motion of a rotary shaft incorporated in the link mechanism.

9 Claims, 5 Drawing Sheets

RECIPROCATING PISTON ENGINE AND ITS LINK MECHANISM

BACKGROUND OF THE INVENTION

1. Field of the Invention

The present invention relates to a reciprocating piston engine and its link mechanism, which is adapted for various types of engines, compressors, pumps, press machines and like machines.

2. Description of the Related Art

In general, a conventional reciprocating piston engine comprises a slider-crank mechanism, which is constructed of: a piston rectilinearly reciprocating in a cylinder; a connecting rod, which has one of its opposite ends rotatably connected with the piston through a piston pin and the other rotatably connected with a crankshaft. In this construction, the piston has its rectilinear reciprocating motion transmitted to the crankshaft through the connecting rod to convert such reciprocating motion into motion of rotation.

In moving the piston up and down in the conventional reciprocating piston engine, the connecting rod is tilted from the direction in which the piston moves. Due to this tilt of the connecting rod, a so-called piston slapping occurs, which is a big factor in producing vibration, noise and frictional loss in the conventional reciprocating piston engine.

Further, in operation, reciprocating masses in the piston and the connecting rod produce unbalanced motion. Due to such unbalanced motion, vibration and noise occur in the reciprocating piston engine. In case that the engine is of a multiple-cylinder type, unbalance couples of forces in the engine also produce vibration and noise.

As described above, the conventional types of reciprocating piston engines, reciprocating piston compressors, reciprocating piston pumps and the conventional crank mechanisms of press machines and like machines suffer from the above-mentioned problems.

SUMMARY OF THE INVENTION

Consequently, it is an object of the present invention to provide a link mechanism adapted for reciprocating piston engines, reciprocating piston compressors, reciprocating piston pumps and press machines and like machines, which mechanism is substantially free from any of the above problems of vibration, noise and friction loss, and is excellent in mechanical efficiency, small in size and light in weight.

According to a first aspect of the present invention, the above object of the present invention is accomplished by providing:

A link mechanism for a reciprocating piston engine and the like, characterized in that:

motions of a pair of cylinder-type pistons moving in opposite directions relative to each other are converted into an oscillating-type rotary motion through an oscillating arm provided with a right and a left portion, which portions are equal in mass and in turning radius of their oscillating-type rotary motions; and the oscillating-type rotary motion is divided into two equal parts by connecting rod means and transmitted to the link mechanism in which the two equal parts of the oscillating-type rotary motion are converted into a rotary motion of a rotary shaft incorporated in the link mechanism. In this link mechanism, the piston path in operation may be rectilinear or circularly-curved.

According to a second aspect of the present invention, the above object of the present invention is accomplished by providing:

A link mechanism for a reciprocating piston engine and the like, characterized in that:

motions of a pair of circularly-curved-type pistons moving in opposite directions relative to each other are converted into an oscillating-type rotary motion through an oscillating arm provided with a right and a left portion, which portions are equal in mass and in turning radius of their oscillating-type rotary motions; and the oscillating-type rotary motion is divided into two equal parts by connecting rod means and transmitted to the link mechanism in which the two equal parts of the oscillating-type rotary motion are converted into a rotary motion of a rotary shaft incorporated in the link mechanism. According to a third aspect of the present invention, the above object of the present invention is accomplished by providing:

A link mechanism for a reciprocating piston engine and the like, characterized in that:

motions of a pair of vane-type pistons moving in opposite directions relative to each other are converted into an oscillating-type rotary motion through an oscillating arm provided with a right and a left portion, which portions are equal in mass and in turning radius of their oscillating-type rotary motions; and the oscillating-type rotary motion is divided into two equal parts by connecting rod means and transmitted to the link mechanism in which the two equal parts of the oscillating-type rotary motion are converted into a rotary motion of a rotary shaft incorporated in the link mechanism.

According to a fourth aspect of the present invention, the above object of the present invention is accomplished by providing:

A link mechanism characterized in that:

an oscillating-type rotary motion of an oscillating-type rotary shaft is divided into two equal parts by connecting rod means and transmitted to the link mechanism in which the two equal parts of the oscillating-type rotary motion are converted into a rotary motion of a rotary shaft incorporated in the link mechanism.

In the link mechanism of the present invention described above, in case that the piston path is rectilinear, the tilt of the connecting rod means from the direction in which the piston rectilinearly reciprocates is very small, so that a lateral pressure imposed on the piston is very small. Further, in case that the piston path is circularly-curved, substantially no lateral pressure is imposed on the piston. In any case, vibration and mechanical noise are negligible in the link mechanism of the present invention.

Further, in the link mechanism of the present invention, torque of the oscillating-type rotary shaft is bisected by the connecting rod means and transmitted to the rotary shaft, i.e., crank shaft, so that any unbalanced motion is completely eliminated. Furthermore, in the link mechanism of the present invention, both the connnecting rod means and the crank shaft are reduced in turning radius, and, therefore improved in rigidity, which reduces vibration and noise. Since a crank pin and the crank shaft are reduced in diameter, frictional loss is also reduced. These reductions in vibration, noise and frictional loss realize the link mechanism of the present invention for converting a reciprocating motion into a rotary motion or vice versa with a high degree of efficiency.

DESCRIPTION OF THE PREFERRED EMBODIMENTS

Hereinbelow, the present invention will be described in detail with reference to the accompanying drawings.

Figure 1:
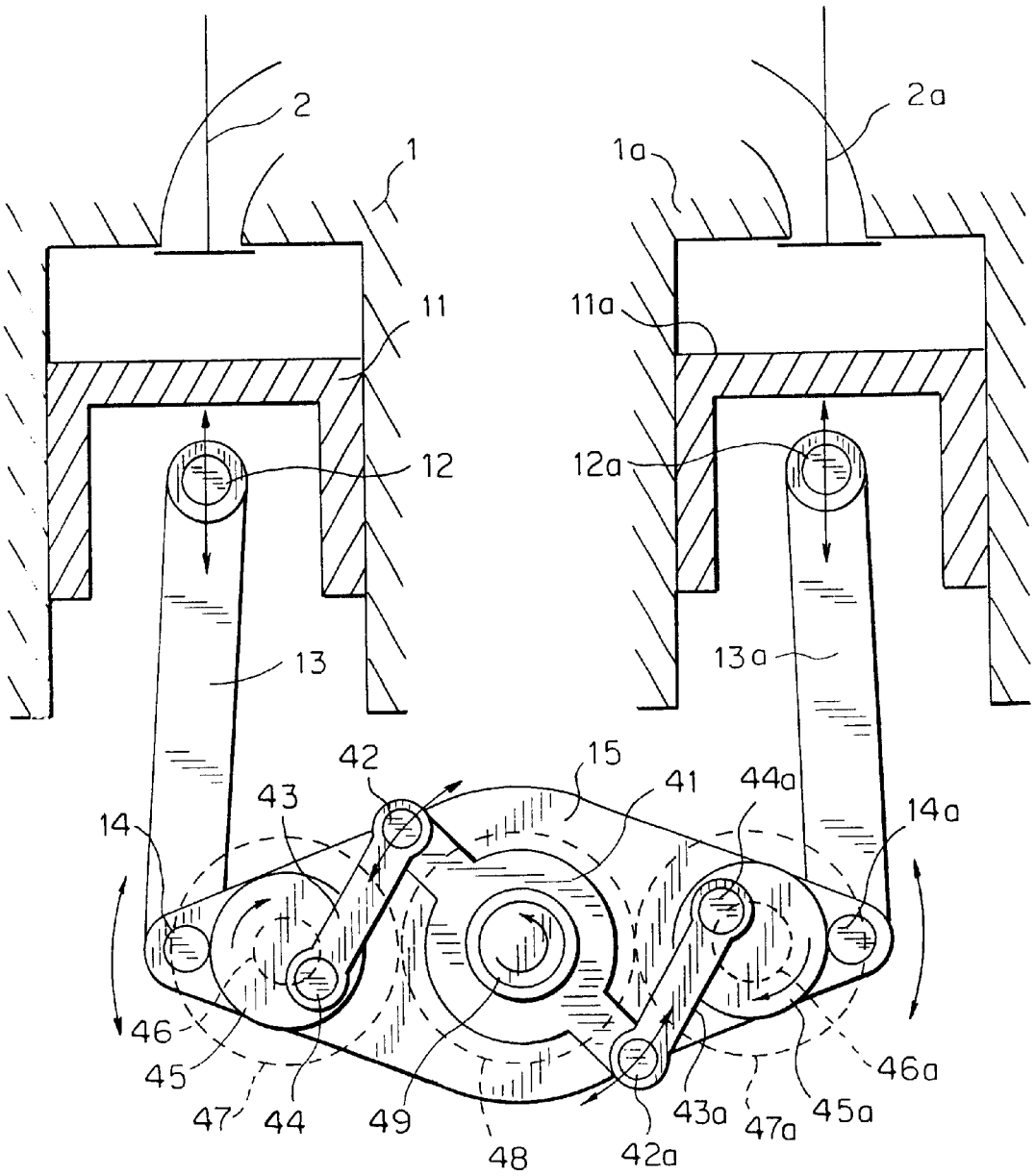
FIG. 1 is a partially broken front view of the cylinder-type piston engine according to the present invention, illustrating the longitudianl section of the piston portion of the engine.
Figure 2:
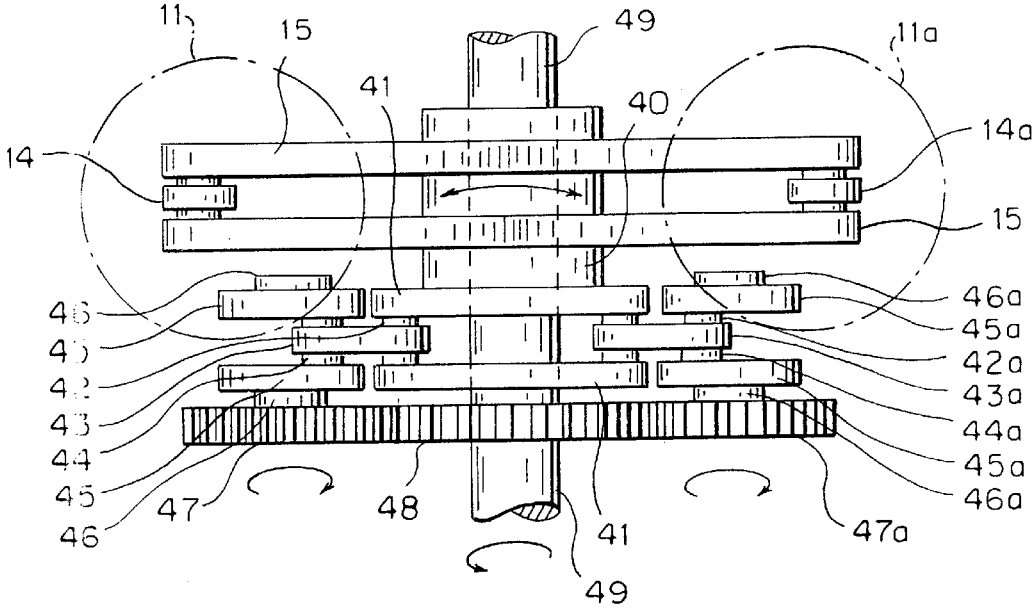
FIG. 2 is a plan view of the cylinder-type piston engine according to the present invention.

Referring now to FIGS. 1 and 2, there is shown a first embodiment of the present invention, i.e., a cylinder-type piston engine, in which a pair of cylinder-type pistons 11 and 11*a* rectilinearly reciprocate in their corresponding cyliner cases 1 and 1*a,* respectively. The cylinder cases 1 and 1*a* are provided with valve mechanisms 2 and 2*a,* respectively.

The cylinder-type pistons 11 and 11*a* are connected with connecting rods 13 and 13*a* through piston pins 12 and 12*a,* respectively. These two cylinder-type pistons 11 and 11*a* are equal in mass and size. The same is true between the connecting rods 13 and 13*a.* As will be hereinafter more fully described, in following each of the cylinder-type pistons 11, 11*a* in operation, each of the connecting rods 13, 13*a* is slightly tilted from a direction in which each of the cylinder-type pistons 11, 11*a* moves.

The connecting rods 13 and 13*a* have their remaining end portions rotatably connected with opposite end portions of an oscillating arm 15 through oscillating arm pins 14 and 14*a,* respectively. The oscillating arm 15 has its central portion fixedly mounted on an oscillating-type rotary shaft 40, and is supported thereby. Consequently, in operation, the oscillating-type rotary shaft 40 is driven in an oscillating manner through the oscillating arm 15 as the cylinder-type pistons 11, 11*a* move up and down. The oscillating arm 15 is provided with a left and a right portion with respect to the oscillating-type rotary shaft 40, which portions are equal in mass and in turning radius in their oscillating motions. Incidentally, though there are provided a pair of the cylinder-type pistons 11, 11*a* in the first embodiment of the present invention shown in FIG. 1, the number of the pistons is not limited to two only. In other words, a plurality of pairs of the pistons may be installed in the engine of the present invention. Further, a plurality of the link mechanisms of the present invention may be combined in use.

An oscillating-type rotary arm 41 is fixedly mounted on the oscillating-type rotary shaft 40, and has its opposite end portions rotatably connected with connecting rods 43 and 43*a* through oscillating-type rotary arm pins 42 and 42*a,* respectively. The oscillating-type rotary arm 41 is provided with opposite end arms which are equal in turning radius in their oscillating-type rotary motions. Further, the connecting rods 43, 43*a* are equal in mass and size. The connecting rods 43 and 43*a* has their remaining end portions rotatably connected with crank pins 44 and 44*a,* respectively. These crank pins 44 and 44*a* are eccentrically connected with disc cranks 45 and 45*a,* respectively.

The disc cranks 45 and 45*a* are supported by crank rotary shafts 46 and 46*a,* respectively. These crank rotary shafts 46 and 46*a* are fixedly mounted on central portions of the disc cranks 45 and 45*a,* respectively. In operation, equally divided torque is applied to each of the disc cranks 45 and 45*a,* which rotatably drive the crank rotary shafts 46 and 46*a,* respectively. Drive gears 47 and 47*a* are fixedly mounted on the corresponding end portions of the crank rotary shafts 46 and 46*a,* respectively. These drive gears 47, 47*a* are meshed with a driven gear 48 fixedly mounted on a rotary shaft 49, which forms a power output shaft. Consequently, in operation, the driven gear 48 is rotatably driven by the drive gears 47, 47*a.*

The link mechanism of the present invention having the above construction operates as follows: namely, when the cylinder-type pistons 11, 11*a* moves up and down in opposite directions relative to each other, the oscillating arm 15 is oscillated or swung on a longitudinal center axis of the oscillating-type rotary shaft 40 as if it were a seesaw. As a result, the oscillating-type rotary shaft 40 sets up an oscillating-type rotary motion. This motion is equally divided and transmitted to each of the connecting rods 43, 43*a* through the oscillating-type rotary arm 41, and further transmitted to each of the disc cranks 45, 45*a* in which the thus equally divided motion is converted into a rotary motion. After that, the thus converted rotary motion of each of the disc cranks 45, 45*a* is transmitted to each of the drive gears 47, 47*a,* and summed up by the driven gear 48 to rotatably drive the rotary shaft 49 on which the driven gear 48 is fixedly mounted.

In the above operation, the amount of tilt in each of the connecting rods 13, 13*a* when the cylinder-type pistons 11, 11*a* move up and down is very small since such tilt remains in a range of the path of each of the oscillating arm pins 14, 14*a.* Consequently, the lateral pressure in each of the pistons 11, 11*a* caused by the tilt of each of the connecting rods 13, 13*a* is very small. Due to this, any of vibration, noise and frictional loss caused by a large lateral pressure of the piston, is remarkably reduced, which improves the link mechanism of the present invention in mechanical efficiency to a large extent.

As is clear from FIG. 1, since the piston engine shown here has a right and a left half portion thereof be substantially equal in reciprocating mass, there is substantially no unbalanced motion in the piston portion of the engine. Incidentally, each of the right and the left half portion of the engine shown in FIG. 1 comprises: the cylinder-type piston 11 or 11*a*; piston pin 1 or 12*a;* connecting rod 13 or 13*a*; oscillating arm pin 14 or 14*a*; and, a left or a right half portion of the oscillating arm 15. Further, in operation of the mechanism for converting the oscillating-type rotary motion into the rotary motion, the power of the oscillating-type rotary shaft 40 is equally divided and transmitted to the crank rotary shafts 46, 46*a* through the connecting rods 43, 43*a,* so that the rotary shaft 49 is rotatably driven through the drive gears 47, 47*a* and the driven gear 48. Consequently, there is no unbalanced motion in the above mechanism.

Further, transmission of the power through the connecting rods 43, 43*a* is performed in the same plane so that any couple of forces are not produced therein.

Due to the above operation in the mechanism of the present invention, frictional loss caused by the lateral pressure of the piston is reduced, which improves the mechanism of the present invention in mechanical efficiency. Further, in the mechanism of the present invention, vibration and noise both caused by inertia forces are substantially eliminated. As for vibration and noise both caused by the couple of forces, they are also substantially eliminated.

Figure 3:
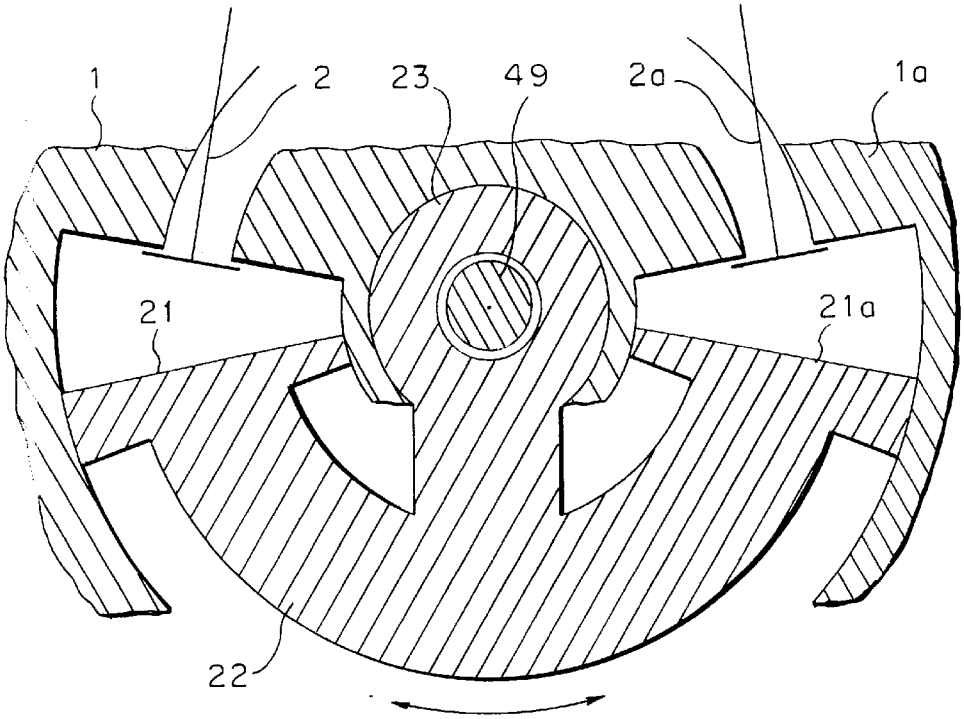
FIG. 3 is a sectional view of the piston portion of the circularly-curved-type piston engine according to the present invention.
Figure 4:
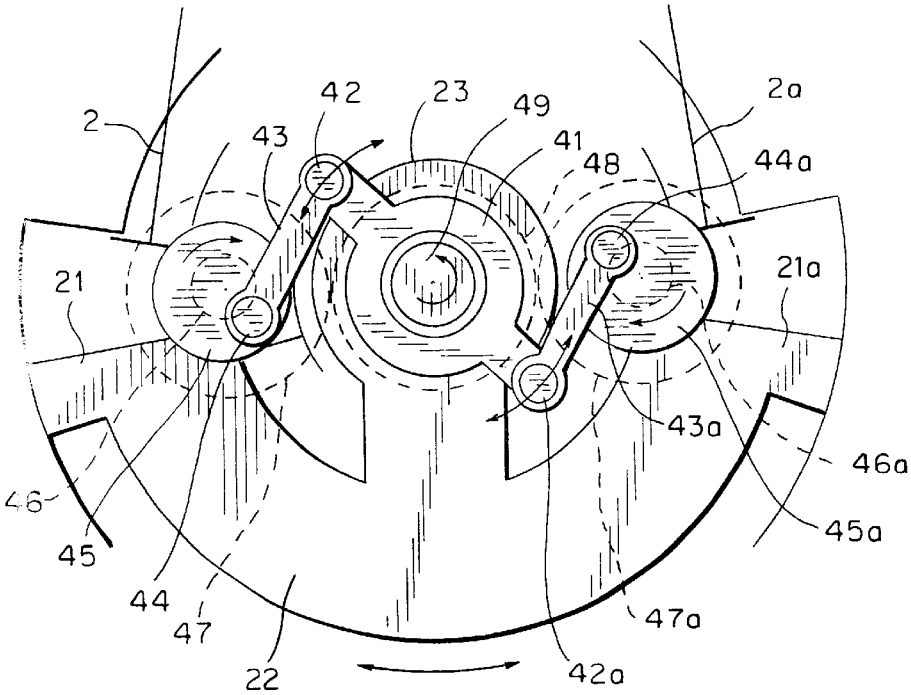
FIG. 4 is a front view of the circularly-curved-type piston engine according to the present invention.
Figure 5:
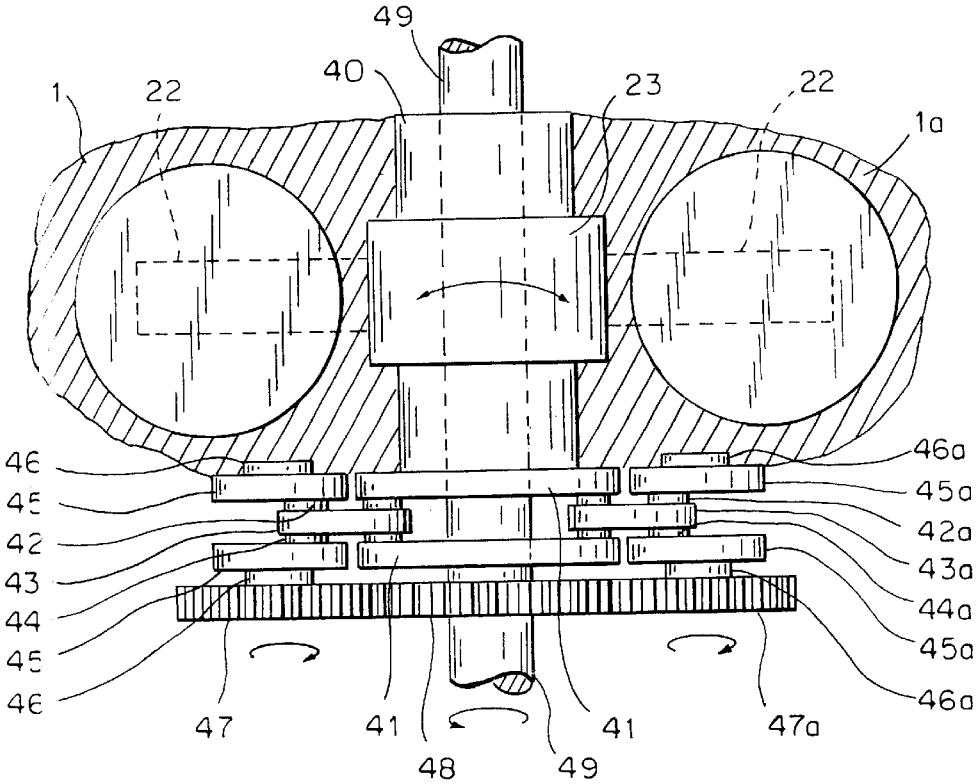
FIG. 5 is a plan view of the circularly-curved-type piston engine according to the present invention.

Now, a second embodiment of the present invention will be described with reference to FIGS. 3 to 5. This second embodiment is an engine in which each of circularly-curved-type pistons 21, 21*a* performs a circularly-curved-type reciprocating motion. In the drawings: the reference numerals 1, 1*a* denote cylinder cases; and, the reference numerals 2, 2*a* denote valve mechanisms.

Fixedly mounted on the circularly-curved-type pistons 21, 21*a* are the oscillating arm 22 and a counter weight 23. The oscillating-type rotary shaft 40 is mounted on a center of oscillating motion, i.e., fixedly mounted on a central portion of the counter weight 23, so that both the oscillating arm 22 and the counter weight 23 are rotatably supported by the oscillating-type rotary shaft 40. When the circularly-curved-type pistons 21, 21*a* move in their circularly-curved directions, the oscillating-type rotary shaft 40 is driven by the oscillating arm 22 to perform its oscillating-type rotary motion. A right and a left half portion of the oscillating arm 22 with respect to a center axis of the oscillating-type rotary shaft 40 are equal in mass and shape. Incidentally, in the second embodiment of the present invention shown in FIGS. 3 to 5, there are provided a pair of the circularly-curved-type pistons 21, 21*a*. However, the number of the pistons 21, 21*a* is not limited thereto. A plurality of pairs of the pistons may be used. Further, a plurality of the mechanisms of the present invention may be combined with each other in the present invention.

In construction, the oscillating-type rotary arm 41 is fixedly mounted on the oscillating-type rotary shaft 40, and has its opposite end portions rotatably connected with the connecting rods 43 and 43*a* through the oscillating-type rotary arm pins 42 and 42*a*, respectively. The opposite arm portions of the oscillating-type rotary arm 41 are equal in turning radius in their oscillating-type rotary motions. Further, the connecting rods 43, 43*a* are equal in mass and shape. The connecting rods 43 and 43*a* have their remaining end portions rotatably connected with the crank pins 44 and 44*a*, respectively. These crank pins 44 and 44*a* are eccentrically mounted on the disc cranks 45 and 45*a*, respectively.

The disc cranks 45 and 45*a* are supported by the crank rotary shafts 46 and 46*a*, respectively. Theses crank rotary shafts 46 and 46*a* are mounted on central portions of the disc cranks 45 and 45*a*, respectively. In operation, the disc cranks 45 and 45*a* rotatably drive the crank rotary shafts 46 and 46*a* with equal torque, respectively. The crank rotary shafts 46 and 46*a* have their end portions fixedly connected with the drive gears 47 and 47*a*, respectively. These drive gears 47, 47*a* are meshed with the driven gear 48 fixedly mounted on the rotary shaft 49, which forms a power output shaft, so that the driven gear 48 is rotatably driven by the drive gears 47, 47*a* in operation.

The link mechanism of the present invention having the above construction operates as follows: namely, when the circularly-curved-type pistons 21, 21*a* moves in opposite directions relative to each other to perform their circularly-curved-type motions, the oscillating arm 22 is oscillated or swung on a longitudinal center axis of the oscillating-type rotary shaft 40 as if it were a seesaw. As a result, the oscillating-type rotary shaft 40 sets up an oscillating-type rotary motion. This motion is equally divided and transmitted to each of the connecting rods 43, 43*a* through the oscillating-type rotary arm 41, and further transmitted to each of the disc cranks 45, 45*a* in which the thus equally divided motion is converted into a rotary motion. After that, the thus converted rotary motion of each of the disc cranks 45, 45*a* is transmitted to each of the drive gears 47, 47*a*, and summed up in the driven gear 48 to rotatably drive the rotary shaft 49 on which the driven gear 48 is fixedly mounted.

In the above operation, any lateral pressure in each of the pistons 21, 21*a* in their circularly-curved-type motions is eliminated, and, therefore any of vibration, noise and frictional loss caused by a large lateral pressure of each of the pistons is also eliminated, which improves the link mechanism of the present invention in mechanical efficiency to a large extent.

Further, there is no unbalanced motion as to the right and the left circularly-curved-type pistons 21 and 21*a*, oscillating arm 22 and the counter weight 23. Furthermore, in operation of the mechanism for converting the oscillating-type rotary motion into a rotary motion, the power of the oscillating-type rotary shaft 40 is equally divided and transmitted to the crank rotary shafts 46, 46*a* through the connecting rods 43, 43*a*, so that the rotary shaft 49 is rotatably driven through the drive gears 47, 47*a* and the driven gear 48. Consequently, there is no unbalanced motion in the above mechanism. Further, transmission of the power through the connecting rods 43, 43*a* is performed in the same plane so that any couple of forces are not produced therein.

Due to the above operation in the mechanism of the present invention, frictional loss caused by the lateral pressure of the piston is eliminated, which improves the mechanism of the present invention in mechanical efficiency Further, in the mechanism of the present invention, vibration and noise both caused by inertia forces are substantially eliminated. Furthermore, in the second embodiment of the present invention shown in FIG. 3, it is possible to reduce the reciprocating mass of the circularly-curved-type pistons 21, 21*a* to at least a half of that of the corresponding conventional reciprocating piston, which improves the engine in power output performance to a large extent.

Figure 6:
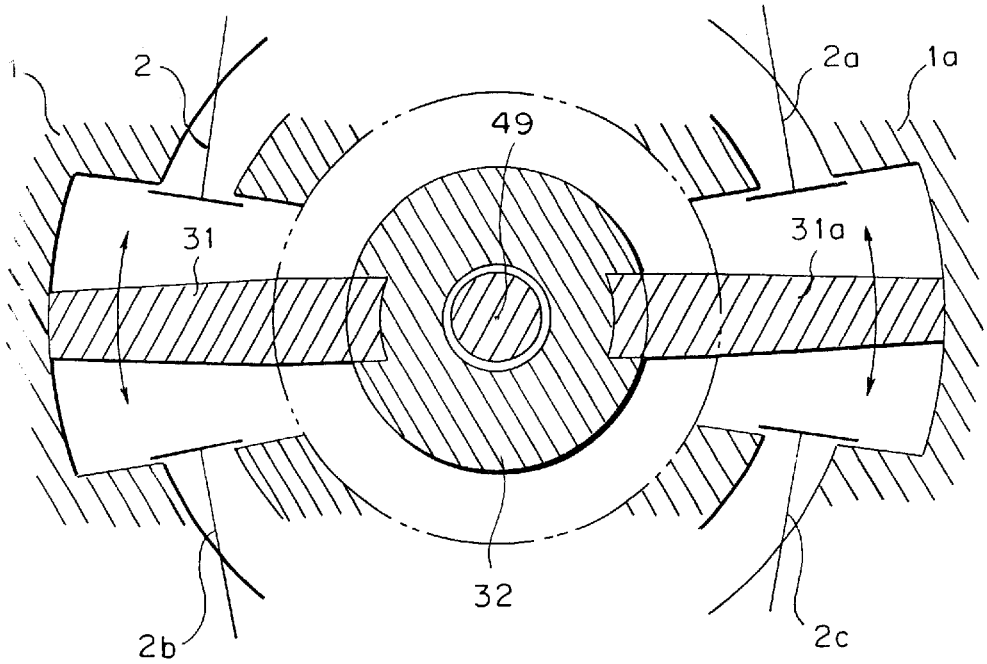
FIG. 6 is a sectional view of the piston portion of the vane-type piston engine according to the present invention.
Figure 7:
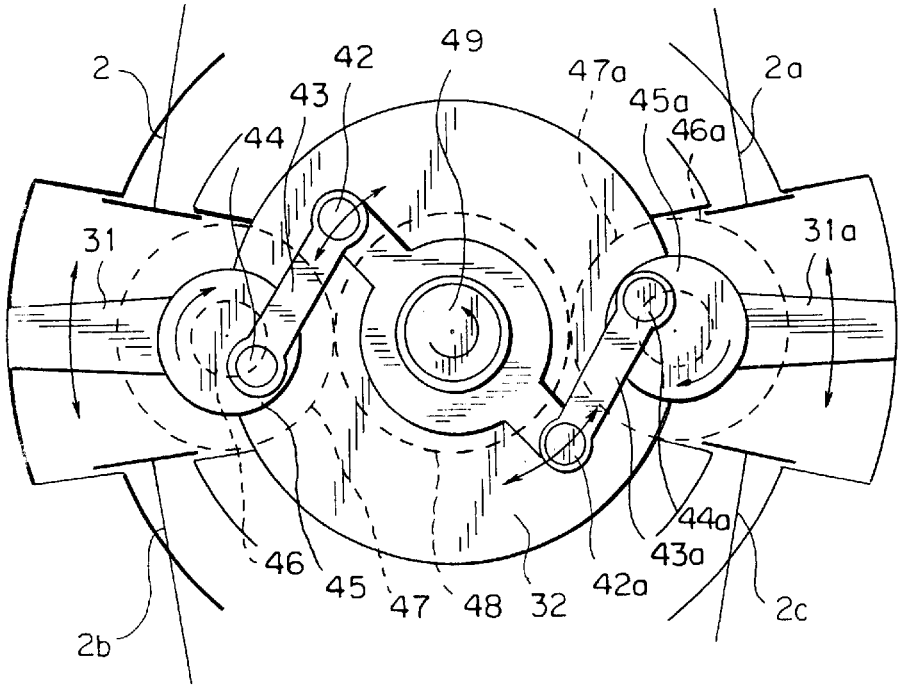
FIG. 7 is a front view of the vane-type piston engine according to the present invention.
Figure 8:
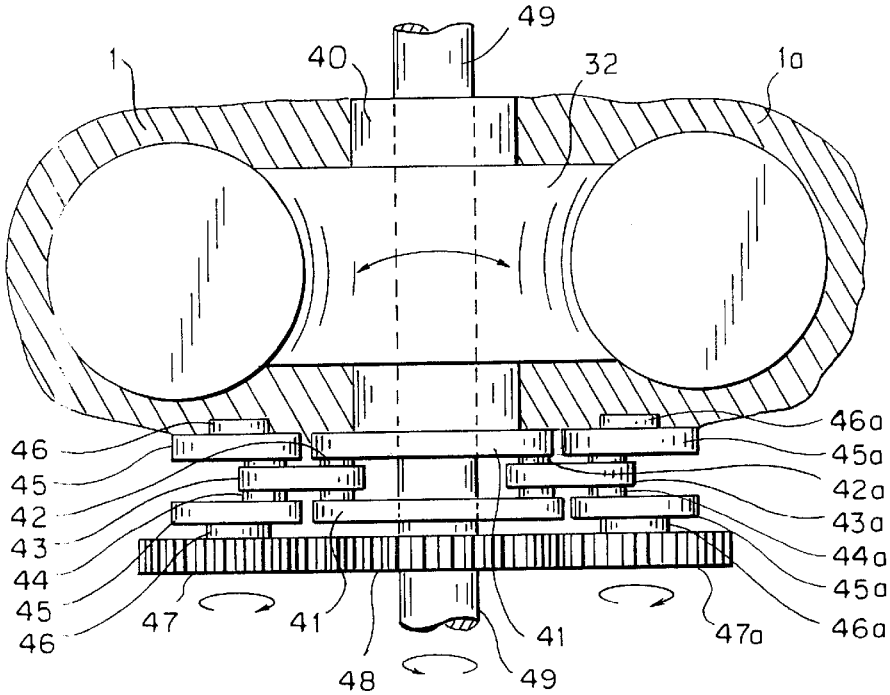
FIG. 8 is a plan view of the vane-type piston engine according to the present invention.

Now, a third embodiment of the present invention will be described with reference to FIGS. 6 to 8. This third embodiment of the present invention is a double-acting engine in which each of a pair of vane-type pistons 31, 31*a* performs a circularly-curved-type reciprocating motion. The engine shown in FIG. 6 may be called the displacement-type turbine engine. In the drawings: the reference numerals 1, 1*a* denote cylinder cases; and, the reference numerals 2, 2*a*, 2*b*, 2*c* denote valve mechanisms.

Fixedly mounted on the vane-type pistons 31, 31*a* is the oscillating arm 32. The oscillating-type rotary shaft 40 is mounted on a center of oscillating motion performed by the oscillating arm 32, and rotatably supports the vane-type pistons 31, 31*a* thereon. In operation, When the vane-type pistons 31, 31*a* move in their circularly-curved directions, the oscillating-type rotary shaft 40 is driven by the oscillating arm 32 to perform its oscillating-type rotary motion. A right and a left half portion of the oscillating arm 32 with respect to a center axis of the oscillating-type rotary shaft 40 are equal in mass and shape. Incidentally, in the third embodiment of the present invention shown in FIGS. 6 to 8, there are provided a pair of the vane-type pistons 31, 31*a*. However, the number of the pistons 31, 31*a* is not limited thereto. A plurality of pairs of the pistons may be used. Further, a plurality of the mechanisms of the present invention may be combined with each other in the present invention.

In construction, the oscillating-type rotary arm 41 is fixedly mounted on the oscillating-type rotary shaft 40, and has its opposite end portions rotatably connected with the connecting rods 43 and 43*a* through the oscillating-type rotary arm pins 42 and 42*a,* respectively. The opposite arm portions of the oscillating-type rotary arm 41 are equal in turning radius in their oscillating-type rotary motions. Further, the connecting rods 43, 43*a* are equal in mass and shape. The connecting rods 43 and 43*a* have their remaining end portions rotatably connected with the crank pins 44 and 44*a,* respectively. These crank pins 44 and 44*a* are eccentrically mounted on the disc cranks 45 and 45*a,* respectively.

The disc cranks 45 and 45*a* are supported by the crank rotary shafts 46 and 46*a,* respectively. Theses crank rotary shafts 46 and 46*a* are mounted on central portions of the disc cranks 45 and 45*a,* respectively. In operation, the disc cranks 45 and 45*a* rotatably drive the crank rotary shafts 46 and 46*a* with equal torque, respectively. The crank rotary shafts 46 and 46*a* have their end portions fixedly connected with the drive gears 47 and 47*a,* respectively. These drive gears 47, 47*a* are meshed with the driven gear 48 fixedly mounted on the rotary shaft 49, which forms a power output shaft, so that the driven gear 48 is rotatably driven by the drive gears 47, 47*a* in operation.

The link mechanism of the present invention having the above construction operates as follows: namely, when the vane-type pistons 31, 31*a* moves in opposite directions relative to each other to perform their circularly-curved-type motions, the oscillating arm 32 is oscillated or swung on a longitudinal center axis of the oscillating-type rotary shaft 40 as if it were a seesaw. As a result, the oscillating-type rotary shaft 40 sets up an oscillating-type rotary motion. This motion is equally divided and transmitted to each of the connecting rods 43, 43*a* through the oscillating-type rotary arm 41, and further transmitted to each of the disc cranks 45, 45*a* in which the thus equally divided motion is converted into a rotary motion. After that, the thus converted rotary motion of each of the disc cranks 45, 45*a* is transmitted to each of the drive gears 47, 47*a,* and summed up in the driven gear 48 to rotatably drive the rotary shaft 49 on which the driven gear 48 is fixedly mounted.

In the above operation, any lateral pressure in each of the pistons 31, 31*a* in their circularly-curved-type motions is eliminated, and, therefore any of vibration, noise and frictional loss caused by a large lateral pressure of each of the pistons is also eliminated, which improves the link mechanism of the present invention in mechanical efficiency to a large extent.

Further, there is substantially no unbalanced motion as to the right and the left circularly-curved-type pistons 21 and 21*a,* and the oscillating arm 32. Furthermore, in operation of the mechanism for converting the oscillating-type rotary motion into a rotary motion, the power of the oscillating-type rotary shaft 40 is equally divided and transmitted to the crank rotary shafts 46, 46*a* through the connecting rods 43, 43*a,* so that the rotary shaft 49 is rotatably driven through the drive gears 47, 47*a* and the driven gear 48. Consequently, there is substantially no unbalanced motion in the above mechanism. Further, transmission of the power through the connecting rods 43, 43*a* is performed in the same plane so that any couple of forces are not produced therein.

Due to the above operation in the mechanism of the present invention, frictional loss caused by the lateral pressure of the piston is eliminated, which improves the mechanism of the present invention in mechanical efficiency. Further, in the mechanism of the present invention, vibration and noise both caused by inertia forces are substantially eliminated. Furthermore, in the third embodiment of the present invention shown in FIGS. 6 to 8, it is possible to reduce the reciprocating masses of the vane-type pistons 31, 31*a* to at least a quarter of that of the corresponding conventional reciprocating piston, which improves the engine in its power output performance to a large extent. Further, when the engine of the present invention is of a double-acting type, it is possible for the engine of the present invention to reduce its volume to one thirds of that of the corresponding conventional reciprocating piston engine, which enables the mechanism of the present invention to be small in size, light in weight and low in cost.

Finally, a fifth embodiment of the present invention will be described with reference to FIGS. 9 and 10. This fifth embodiment of the present invention is a link mechanism for converting a reciprocating motion into a rotary motion or vice versa.

Figure 9:
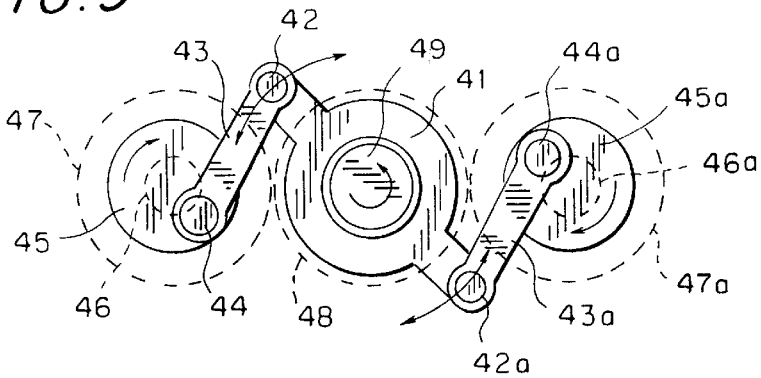
FIG. 9 is a front view of the link mechanism according the present invention.
Figure 10:
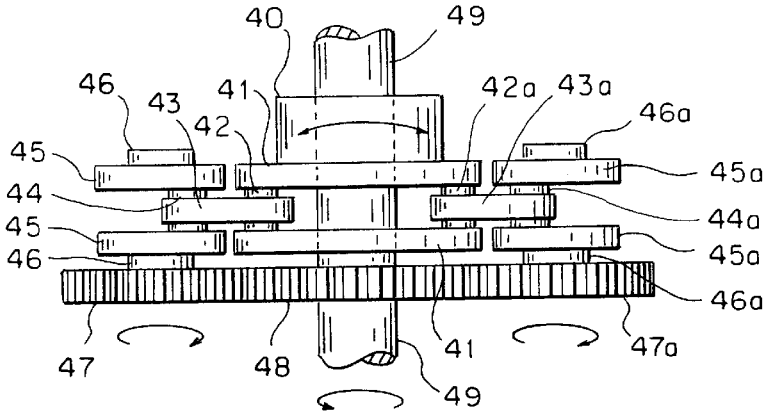
FIG. 10 is a plan view of the link mechanism according to the present invention.

In the link mechanism shown in FIGS. 9 and 10, the oscillating-type rotary arm 41 is fixedly mounted on the oscillating-type rotary shaft 40, and has its opposite end portions rotatably connected with the connecting rods 43 and 43*a* through the oscillating-type rotary arm pins 42 and 42*a,* respectively. The opposite arm portions of the oscillating-type rotary arm 41 are equal in turning radius in their oscillating-type rotary motions. Further, the connecting rods 43, 43*a* are equal in mass and shape. The connecting rods 43 and 43*a* have their remaining end portions rotatably connected with the crank pins 44 and 44*a,* respectively. These crank pins 44 and 44*a* are eccentrically mounted on the disc cranks 45 and 45*a,* respectively.

The disc cranks 45 and 45*a* are supported by the crank rotary shafts 46 and 46*a,* respectively. Theses crank rotary shafts 46 and 46*a* are mounted on central portions of the disc crank s 45 and 45*a,* respectively. In operation, the disc cranks 45 and 45*a* rotatably drive the crank rotary shafts 46 and 46*a* with equal torque, respectively. The crank rotary shafts 46 and 46*a* have their end portions fixedly connected with the drive gears 47 and 47*a,* respectively. These drive gears 47, 47*a* are meshed with the driven gear 48 fixedly mounted on the rotary shaft 49, which forms a power output shaft, so that the driven gear 48 is rotatably driven by the drive gears 47, 47*a* in operation.

The link mechanism of the present invention having the above construction operates as follows: namely, when the oscillating-type rotary shaft 40 sets up an oscillating-type rotary motion. This motion is equally divided and transmitted to each of the connecting rods 43, 43*a* through the oscillating-type rotary arm 41, and further transmitted to each of the disc cranks 45, 45*a* in which the thus equally divided motion is converted into a rotary motion. After that, the thus converted rotary motion of each of the disc cranks 45, 45*a* is transmitted to each of the drive gears 47, 47*a,* and summed up in the driven gear 48 to rotatably drive the rotary shaft 49 on which the driven gear 48 is fixedly mounted.

In the above operation, the power of the oscillating-type rotary shaft 40 is equally divided and transmitted to the crank rotary shafts 46, 46*a* through the connecting rods 43, 43*a,* so that the rotary shaft 49 is rotatably driven through the drive gears 47, 47*a* and the driven gear 48. Consequently, there is no unbalanced motion in the above mechanism. Further, transmission of the power through the connecting rods 43, 43*a* is performed in the same plane so that any couple of forces are not produced therein.

Due to the above operation in the mechanism of the present invention, vibration and noise both caused by inertia forces are substantially eliminated. The same is true as to vibration and noise both caused by the couple of forces. Further, since each of the connecting rods and the crank shaft may reduce its turning radius in the link mechanism of the present invention, it is possible to improve the link mechanism of the present invention in rigidity, and, therefore to reduce its vibration and noise in operation. Further, in the link mechanism of the present invention, each of the crank pin and the crank rotary shaft may reduce its diameter, which enables the link mechanism to reduce its frictional loss. Consequently, it is possible for the present invention to produce the link mechanism which is small in vibration and noise, and excellent in efficiency for converting a reciprocating motion into a rotary motion or vice versa.

As described above, in the reciprocating piston engine or link mechanism according to the present invention, there is substantially no vibration and noise caused by the so-called piston slapping and also caused by the couple of forces. Further, in the link mechanism of the present invention, there is substantially no lateral pressure of the pistons, and each of the crank pin and the crank rotary shaft is reduced in diameter while the link mechanism itself is of the double-acting type, so that the link mechanism of the present invention is remarkably reduced in frictional loss and remarkably improved in mechanical efficiency. Further, the link mechanism or reciprocating piston engine of the present invention is remarkably reduced in weight relative to the conventional reciprocating piston engine, which improves the engine of the present invention in power output performance while permitting the engine to be reduced in volume to at least one thirds of the volume of the conventional reciprocating piston engine. Consequently, it is possible for the link mechanism of the present invention to be small in size, light in weight, and low in cost.

The above construction of the present invention remarkably improves its engine in fuel consumption, electric power consumption, and in reduction of carbon dioxide discharge.

What is claimed is:

1. A link mechanism for a reciprocating piston engine, the engine having a pair of pistons that are operated to move in opposite directions relative to each other, said link mechanism comprising:

an oscillating arm provided with a right portion and a left portion, said oscillating arm being mounted for pivotal movement about a pivot axis and being connected to the pair of pistons to convert movements of the pistons into an oscillating pivotal movement of said oscillating arm about said pivot axis, said right and left portions being equal in mass and in turning radius about said pivot axis;

a first rotary shaft mounted for rotation about said pivot axis; and linkage means coupled between said oscillating arm and said rotary shaft for converting the oscillating pivotal movement of said oscillating arm into rotary motion of said rotary shaft.

2. The link mechanism of claim 1, wherein said linkage means comprise:

a second rotary shaft fixedly mounted to said oscillating arm to undergo oscillating movement with said oscillating arm about said pivot axis;

two disc cranks each rotatable about a respective one of two crank axes; and two connecting rods each connected between said second rotary shaft and a respective one of said disc cranks for converting oscillating pivotal movement of said oscillating arm into rotary movement of said first rotary shaft, each of said disc cranks being connected to be rotated by a respective one of said two connecting rods, wherein said two crank axes and said pivot axis all lie in a common plane.

3. A link mechanism for a pair of pistons that are operated to move in opposite directions relative to each other, said link mechanism comprising:

an oscillating arm provided with a right portion and a left portion, said oscillating arm being mounted for pivotal movement about a pivot axis and being connected to the pair of pistons to convert movements of the pistons into an oscillating pivotal movement of said oscillating arm about said pivot axis, said right and left portions being equal in mass and in turning radius about said pivot axis;

a rotary shaft mounted for rotation about a rotation axis; and linkage means coupled between said oscillating arm and said rotary shaft for deriving two equal movements from the oscillating pivotal movement of said oscillating arm and converting the two equal movements into rotary motion of said rotary shaft.

4. The link mechanism of claim 3 wherein said pistons are cylinder-type pistons.

5. The link mechanism of claim 3 wherein said pistons are circularly-curved-type pistons.

6. The link mechanism of claim 3 wherein said pistons are vane-type pistons.

7. The link mechanism of claim 3 wherein said linkage means comprise connecting rods to which the two equal movements are applied.

8. The link mechanism of claim 7 wherein said linkage means further comprise two disc cranks each rotatable about a respective one of two crank axes and each connected to be rotated by a respective one of said connecting rods, and wherein said two crank axes and said first pivot axis all lie in a common plane.

9. The link mechanism of claim 3 wherein the rotation axis of said rotary shaft coincides with the pivot axis of said oscillating arm.

* * * * *